US010531179B2

(12) United States Patent
Gurunathan

(10) Patent No.: US 10,531,179 B2
(45) Date of Patent: Jan. 7, 2020

(54) BATTERY-LESS, NOISE-CANCELLATION HEADSET

(71) Applicant: Intel Corporation, Santa Clara, CA (US)

(72) Inventor: Meenakshisundaram Gurunathan, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/109,110

(22) Filed: Aug. 22, 2018

(65) Prior Publication Data

US 2019/0124435 A1 Apr. 25, 2019

Related U.S. Application Data

(63) Continuation of application No. 15/268,273, filed on Sep. 16, 2016, now Pat. No. 10,080,078.

(51) Int. Cl.
*H04R 5/033* (2006.01)
*H04R 1/10* (2006.01)
(Continued)

(52) U.S. Cl.
CPC ..... *H04R 1/1083* (2013.01); *H04R 1/1041* (2013.01); *H04R 3/005* (2013.01);
(Continued)

(58) Field of Classification Search
CPC .... H04R 2420/03; H04R 1/1041; H04R 3/00; H04R 29/004; H04R 2410/05; H04R 2420/09; H04R 17/02; H04R 3/005; H04R 5/04; H04R 1/265; H04R 2410/03; H04R 25/556; H04R 1/1083; H04R 29/001; H04R 2430/03; H04R 2460/01
(Continued)

(56) References Cited

U.S. PATENT DOCUMENTS 10,080,078 B2 9/2018 Gurunathan
2001/0053228 A1 12/2001 Jones
(Continued)

FOREIGN PATENT DOCUMENTS

WO WO-2018051369 A1 3/2018

OTHER PUBLICATIONS

"U.S. Appl. No. 15/268,273, Examiner Interview Summary dated Feb. 13, 2018", 3 pgs.
(Continued)

*Primary Examiner* — Norman Yu
(74) *Attorney, Agent, or Firm* — Schwegman Lundberg & Woessner, P.A.

(57) ABSTRACT

Methods and apparatus for a battery-less, noise-cancellation headset compatible with 4-pin audio jack are generally described herein. An example device to support a noise cancellation function may include an audio socket including a microphone contact, and an ambient noise detection module to receive an ambient noise data signal from a headset via the microphone contact, and detect an impedance at the microphone contact. The ambient noise detection module further to provide a first noise cancellation signal responsive to the impedance having a first value and to provide a second noise cancellation signal responsive to the impedance having a second value.

14 Claims, 6 Drawing Sheets

(51) Int. Cl.
*H04R 3/00* (2006.01)
*H04R 29/00* (2006.01)

(52) U.S. Cl.
CPC ..... *H04R 29/001* (2013.01); *H04R 2430/03* (2013.01); *H04R 2460/01* (2013.01)

(58) Field of Classification Search
USPC ..... 381/71.6, 94.5, 384, 123, 369, 58
See application file for complete search history.

(56) References Cited

U.S. PATENT DOCUMENTS

2007/0160223 A1 7/2007 Cusack
2007/0177741 A1* 8/2007 Williamson ..... H04R 1/1083 381/71.6
2011/0033064 A1 2/2011 Johnson et al.
2012/0148062 A1* 6/2012 Scarlett ..... G10K 11/178 381/71.6
2013/0034239 A1* 2/2013 Shin ..... H04R 1/1083 381/74
2018/0084331 A1 3/2018 Gurunathan

OTHER PUBLICATIONS

"U.S. Appl. No. 15/268,273, Non Final Office Action dated Nov. 9, 2017", 15 pgs.
"U.S. Appl. No. 15/268,273, Notice of Allowability dated Jun. 4, 2018", 7 pgs.
"U.S. Appl. No. 15/268,273, Notice of Allowance dated May 15, 2018", 13 pgs.
"U.S. Appl. No. 15/268,273, Response filed Feb. 9, 2018 to Non Final Office Action dated Nov. 9, 2017", 11 pgs.
"U.S. Appl. No. 15/268,273, Response filed Sep. 14, 2017 to Restriction Requirement dated Jul. 14, 2017", 8 pgs.
"U.S. Appl. No. 15/268,273, Restriction Requirement dated Jul. 14, 2017", 6 pgs.

* cited by examiner

BATTERY-LESS, NOISE-CANCELLATION HEADSET

PRIORITY APPLICATION

This application is a continuation of U.S. application Ser. No. 15/268,273, filed Sep. 16, 2016, which is incorporated herein by reference in its entirety.

BACKGROUND

Noise cancellation headsets are becoming popular for providing superior user experience. However, most noise-cancellation headsets require internal noise cancelling circuitry and a battery (to power this circuitry). This type of circuitry tends to make these headsets expensive and bulky, as well as having to frequently charge the battery for the noise cancellation to work.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Certain details are set forth below to provide a sufficient understanding of embodiments of the disclosure. However, it will be clear to one skilled in the art that embodiments of the disclosure may be practiced without various aspects of these particular details. In some instances, well-known circuits, control signals, timing protocols, computer system components, and software operations have not been shown in detail in order to avoid unnecessarily obscuring the described embodiments of the disclosure.

To avoid the battery issues and bulkiness, some designs may include headsets where the noise cancellation is performed at the device to which this headset is plugged. However, these headsets require a non-standard five pin audio jack and hence the noise cancellation feature would work only if they are used with limited set of devices having this non-standard five pin audio jack. Examples described herein include a noise-cancellation headset system that includes a noise cancellation headset and a device that detects noise and provides noise cancellation signals to the noise cancellation headset. The noise cancellation headset may include a standard 4-pin audio jack and may operate without an internal battery/power source, in some examples.

Figure 1:
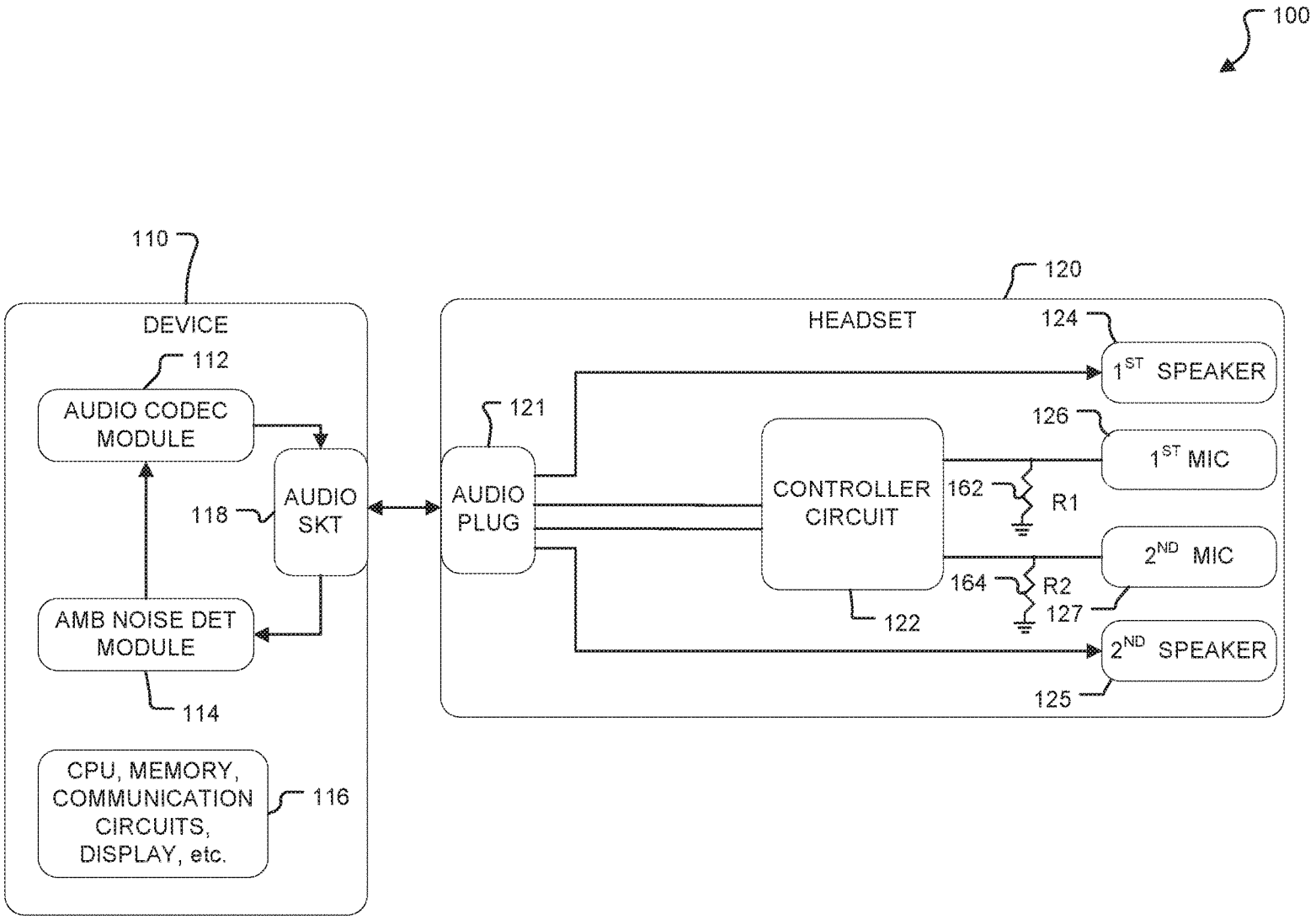
FIG. 1 illustrates a noise-cancellation headset system to provide audible noise cancellation in accordance with some embodiments of the disclosure.

FIG. 1 illustrates a noise-cancellation headset system 100 to provide audible noise cancellation in accordance with some embodiments of the disclosure. The system may include a device 110 coupled to a headset 120. The device 110 may be coupled to the headset 120 via an audio socket 118 and an audio plug 121. The device 110 may detect noise at the headset 120 and provide a noise cancellation signal to the headset 120 to cancel out the noise from the perspective of a user of the headset 120.

The device 110 may include an audio encoder/decoder module 112, an ambient noise detection module 114, a CPU, memory, communication circuits, display, etc. 116 and the audio socket 118. The CPU, memory, communication circuits, display, etc. 116 may perform many functions for the device 110, such as receiving and transmitting data, processing data, storing data, displaying data, etc. For example, the device 110 may be a device capable of providing multimedia data for experience by a user, such as audio, video, pictures, vibration, etc. via the CPU, memory, communication circuits, display, etc. 116. The ambient noise detection module 114 may receive an ambient noise data signal from a headset via a microphone contact on the audio socket 118. The ambient noise detection module 114 may detect an impedance of the microphone contact. Based on the ambient noise data signal, the ambient noise detection module 114 may provide a first noise cancellation signal to the audio encoder/decoder module 112 responsive to the impedance of the microphone contact having a first value and may provide a second noise cancellation signal to the audio encoder/decoder module 112 responsive to the impedance of the microphone contact having a second value. The audio encoder/decoder module 112 may encode and decode audio data to be sent to the headset 120. The ambient noise detection module 114 may also provide the noise cancellation signals to the audio encoder/decoder module 112, and the audio encoder/decoder module 112 may encode the audio signals with the noise cancellation signals. The audio socket 118 may be a socket capable of physically receiving the audio plug 121. In some examples, the audio socket 118 is compatible with a standard 4-pin audio plug.

The headset 120 may include the audio plug 121, a controller circuit 122, a first speaker 124, a second speaker 125, a first microphone 126, and a second microphone 127. The headset 120 may further include a first resistor R1 162 and a second resistor R2 164. In some examples, the audio plug 121 may be a 4-pin audio plug, with a left speaker contact, a right speaker contact, a microphone contact, and a reference signal contact. The first speaker 124 and the first microphone 126 may be included in a first side of the headset 120 and the second speaker 125 and second microphone 127 may be included in a second side of the headset 120. The controller circuit 122 may control provision of a signal from either the first microphone 126 or the second microphone 127 to the audio plug 121, and ultimately to the device 110. The controller circuit 122 may include a multiplexing or switching circuit and a clock circuit to control the switching circuit. The R1 resistor 162 and the R2 resistor 164 may have different impedances such that the detected impedance on the microphone contact of the audio plug 121 is different depending on which of the first microphone 126 or the second microphone 127 is coupled to the audio plug 121.

In operation, the device 110 may be capable of playing multimedia data, including audio. For audio, the audio encoder/decoder module 112 may provide audio signals to the headset 120, to be output to a user/wearer via the first speaker 124 and the second speaker 125. The first speaker 124 and the second speaker 125 may be left and right speakers, for example. In order to improve the user experience, the device 110 and the headset 120 may employ noise cancellation or active noise reduction to reduce an effect ambient noise has on the quality of the audio heard by the user. For example, the audio encoder/decoder module 112 may encode the audio signals with noise cancellation signals to be provided to the headset 120. The noise cancellation signals may cancel out ambient noise heard by the user to improve clarity of the intended audio data. The noise cancellation signals may be determined by the ambient noise detection module 114 based on ambient noise data signals received from the first microphone 126 and the second microphone 127 of the headset 120. In some examples, the first microphone 126 may be proximate to the first speaker 124 and the second microphone 127 may be proximate to the second speaker 125.

The controller circuit 122 may control provision of the ambient noise data signals to the device 110. Because ambient noise may differ at the first speaker 124 as compared with ambient noise at the second speaker 125, the first microphone 126 may provide a first ambient noise data signal and the second microphone 127 may provide a second ambient noise data signal. However, a standard 4-pin audio plug has only one contact for a microphone output. Thus, the controller circuit 122 may toggle between providing the first ambient noise data signal from the first microphone 126 and the second ambient noise data signal from the second microphone 127. To control the switch rate, the controller circuit 122 may include a clock circuit that toggles the switching circuit. The switch rate may be based on the audible frequency range of the human ear, which is generally understood to be between 20 Hz and 20 KHz. For example, the switch rate may be set at 40 KHz in order to capture 20 KHz ambient noise data at each of the first microphone 126 and the second microphone 127. In other embodiments, because ambient noise is typically lower frequencies, the switch rate may be set at a lower rate than 40 KHz.

The headset 120 may include the R1 resistor 162 and the R2 resistor 164, each having different impedances, on the lines from the first microphone 126 and the second microphone 127, respectively. The R1 resistor 162 may be coupled between a ground node and a node between the first microphone 126 and the controller circuit 122. The R2 resistor 164 may be coupled between the ground node and a node between the second microphone 127 and the controller circuit 122. Without some other identifying information, the audio encoder/decoder module 112 may be unable to determine whether the noise data signal is from the first microphone 126 or the second microphone 127 because both are received via the same contact on the audio plug 121. However, because the R1 resistor 162 and the R2 resistor 164 each have different impedances, the sensed impedances from the first microphone 126 and the second microphone 127 may be different. Thus, the ambient noise detection module 114 may determine which of the first microphone 126 or the second microphone 127 the noise data signal is from based on the sensed impedance.

The ambient noise detection module 114 may construct a first noise cancellation signal for the first speaker 124 based on the noise data signal received from the first microphone 126. The ambient noise detection module 114 may construct a second noise cancellation signal associated with the second speaker 125 based on the noise data signal received from the second microphone 127. The first and second noise cancellation signals may be provided to the audio encoder/decoder module 112. The audio encoder/decoder module 112 may encode a respective audio signal for each of the first speaker 124 and the second speaker 125 based on audio data received from the CPU, memory, communication circuits, display, etc. 116 and the respective noise cancellation signals. The respective audio signals may be provided to the first speaker 124 and the second speaker 125 via the audio encoder/decoder module 112/audio plug 121 interface, and the first speaker 124 and second speaker 125 may output audio based on the respective audio signals.

The system 100 depicted and described in FIG. 1 provides a noise cancellation interface that uses the standard 4-pin audio plug interface, which may allow for easier forward and backward compatibility. The system 100 depicted and described in FIG. 1 may also provide a means for simpler noise cancellation circuitry and may eliminate a need for a battery at the headset 120, with the complex noise cancellation processing being performed at the device 110.

Figure 2:
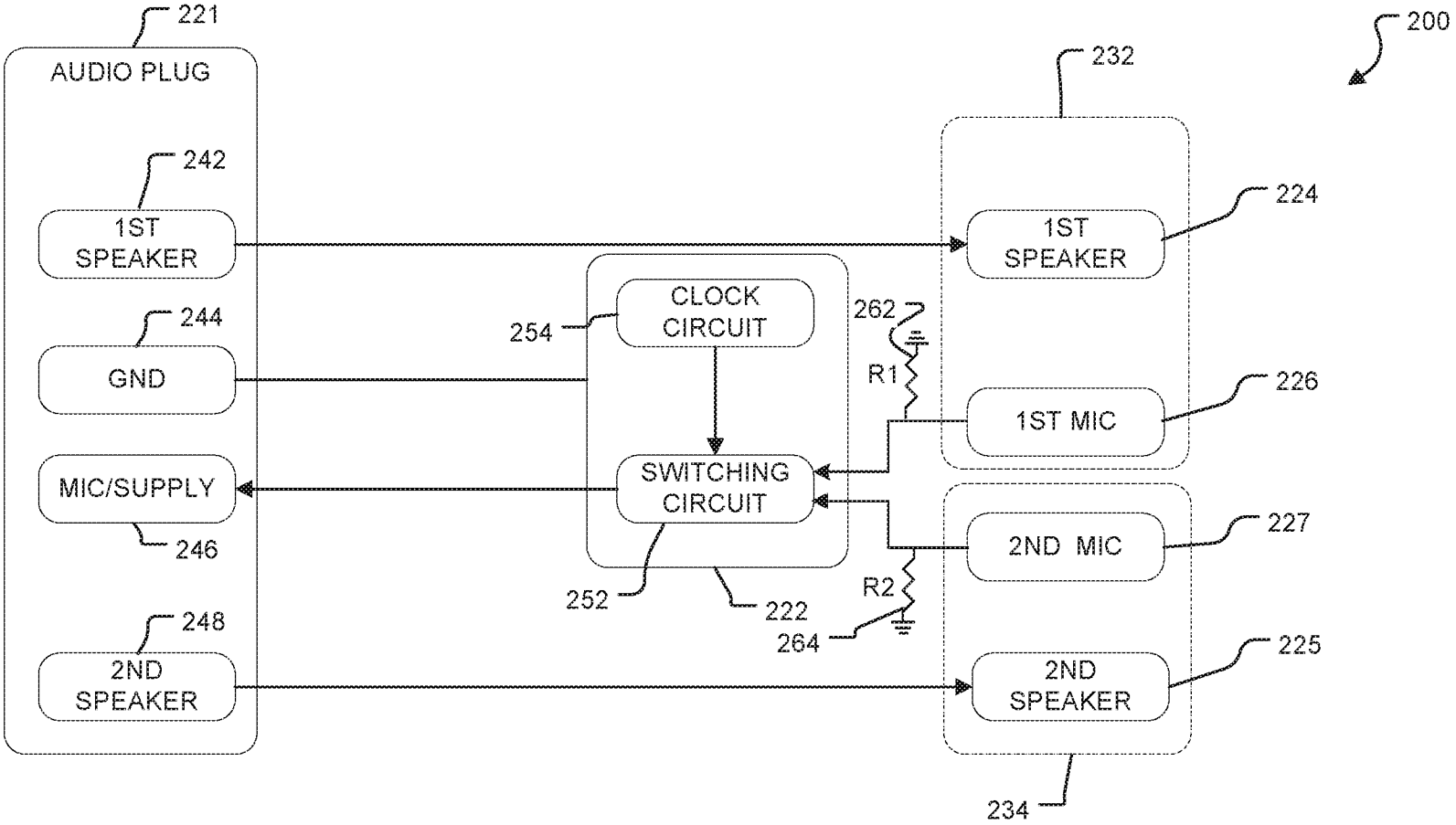
FIG. 2 illustrates a noise cancellation headset to provide ambient noise cancellation in accordance with some embodiments of the disclosure.

FIG. 2 illustrates a noise cancellation headset 200 to provide ambient noise cancellation in accordance with some embodiments of the disclosure. The headset 200 may include an audio plug 221, a controller circuit 222, a first earpiece 232, and second earpiece 234. The headset 200 may be implemented in the headset 120 of FIG. 1.

The audio plug 221 may include four contacts: a first speaker contact 242, a ground contact 244, a microphone/supply contact 246, and a second speaker contact 248. The first speaker contact 242 may receive and provide a first audio signal to the first earpiece 232 and the second speaker contact 248 may receive and provide a second audio signal to the second earpiece 234. The microphone/supply contact 246 may receive a first or second ambient noise data signal from the controller circuit 222 and provide the first or second ambient noise data signal to another device (e.g., the device 110 of FIG. 1). The controller circuit 222 may include a switching circuit 252 and a clock circuit 254. The clock circuit 254 may include an oscillation circuit designed to operate at a specific frequency. The switching circuit 252 may include a switch controlled by the oscillations of the clock circuit 254, such as a single pole, double throw switch.

The first earpiece 232 may include a first speaker 224 and a first microphone 226. The first speaker 224 may be coupled to the first speaker contact 242 to receive the first audio signal. The first microphone 226 may be coupled to the switching circuit 252 to provide a first ambient noise data signal. The headset 200 may include a first resistor R1 262 coupled to a line between the first microphone 226 and the switching circuit 252. The second earpiece 234 may include a second speaker 225 and a second microphone 227. The second speaker 225 may be coupled to the second speaker contact 248 to receive the second audio signal. The second microphone 227 may be coupled to the switching circuit 252 to provide a second ambient noise data signal. The headset 200 may include a second resistor R2 264 coupled to a line between the second microphone 227 and the switching circuit 252. The R1 resistor 262 and R2 resistor 264 may have different impedances.

In operation, the headset 200 may be capable of playing audio via the first earpiece 232 and the second earpiece 234. In some examples, the first and second audio signals may include both audio signal data and noise-cancellation signal data. The headset 200 may facilitate noise cancellation or active noise reduction that results in the ambient noise cancellation signals. The noise cancellation signals may reduce an affect ambient noise has on the quality of the audio heard by the user. That is, the noise cancellation signals may cancel out ambient noise heard by the user to improve clarity of the intended audio data. The noise cancellation signals may be determined based on ambient noise data signals provided by the first microphone 226 and the second microphone 227. In some examples, the first microphone 226 may be proximate to the first speaker 224 and the second microphone 227 may be proximate to the second speaker 225.

The controller circuit 222 may control provision of the ambient noise data signals. Because ambient noise may differ at the first earpiece 232 as compared with noise at the second earpiece 234, the first microphone 226 may provide a first ambient noise data signal and the second microphone 227 may provide a second ambient noise data signal. However, a standard 4-pin audio plug has only one contact for a microphone output. Thus, the switching circuit 252 may toggle between providing the first ambient noise data signal from the first microphone 226 and the second ambient noise data signal from the second microphone 227. To control the switch rate, the clock circuit 254 may toggle the switching circuit. In some examples, the switch rate may be set at 40 KHz in order to capture 20 KHz ambient noise data at each of the first earpiece 232 and the second earpiece 234. In other embodiments, because ambient noise is typically lower frequencies, the switch rate may be set at a lower rate than 40 KHz.

The headset 200 may include the R1 resistor 262 and the R2 resistor 264, each having different impedances, on the lines from the first microphone 226 and the second microphone 227, respectively. The R1 resistor 262 may be coupled between a ground node and a node between the first microphone 226 and the switching circuit 252. The R2 resistor 264 may be coupled between the ground node and a node between the second microphone 227 and the switching circuit 252. Because the R1 resistor 262 and the R2 resistor 264 each have different impedances, the sensed impedances from the first microphone 226 and the second microphone 227 may be different, allowing an external device to differentiate between the two signals.

The first speaker 224 may receive a first audio signal via the via the first speaker contact 242. The second speaker 225 may receive respective a second audio signal via the via the second speaker contact 248. Each of the first and second audio signals may include respective audio signal data and respective noise cancellation signal data. The first speaker 224 and the second speaker 225 may output audio based on the first and second audio signals, respectively.

The headset 200 depicted and described in FIG. 2 provides a noise cancellation interface that uses the standard 4-pin audio plug interface, which may allow for easier forward and backward compatibility. The headset 200 depicted and described in FIG. 2 may also provide for simpler noise cancellation circuitry and may eliminate a need for a battery.

Figure 3:
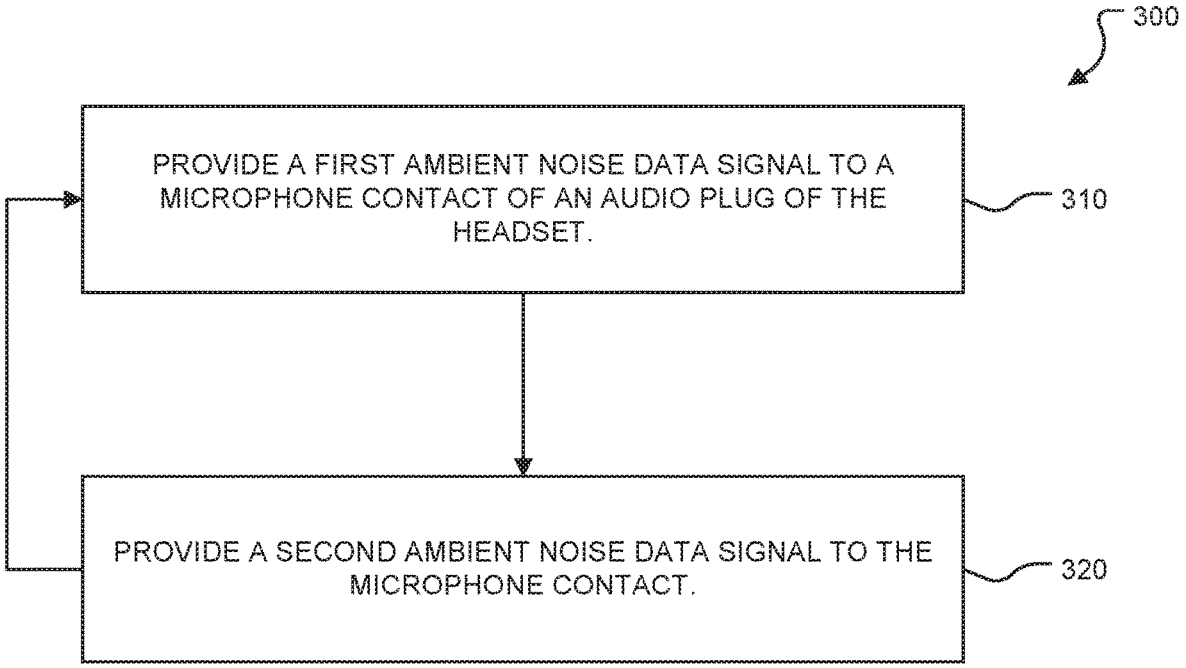
FIG. 3 illustrates a flow diagram of a method to provide ambient noise data from a headset in accordance with some embodiments of the disclosure.

FIG. 3 illustrates a flow diagram of a method 300 to provide ambient noise data from a headset in accordance with some embodiments of the disclosure. The method 300 may be implemented in the headset 120 of FIG. 1, the headset 200 of FIG. 2, or combinations thereof.

The method 300 may include oscillating between providing a first ambient noise data signal to a microphone contact of an audio plug of the headset, at 310, and providing a second ambient noise data signal to the microphone contact, at 320. The audio plug may be the audio plug 121 of FIG. 1, the audio plug 221 of FIG. 2, or combinations thereof. The microphone contact may be the microphone/supply contact 246 of FIG. 2. The switching circuit may be the switching circuit 252 of FIG. 2. The predetermined frequency may be based on an audible frequency range of the human ear, in some examples. The predetermined frequency may be further based on a frequency range of ambient noise, in some examples. In some examples, the predetermined frequency may be 40,000 Hz or less.

The oscillating may include, in an alternating fashion, adjusting a switching circuit to a first configuration to couple the microphone contact to a first microphone to provide the first ambient noise data signal, and adjusting the switching circuit to a second configuration to couple the microphone contact to a second microphone to provide the second ambient noise data signal. A clock circuit, such as the clock circuit 254 of FIG. 2, may control oscillations of the switching circuit.

In some examples, the method 300 may include receiving a first audio signal at a first speaker and receiving a second audio signal at a second speaker of the headset. The first speaker and the second speakers may be the first speaker 124 and second speaker 125 of FIG. 1, the first speaker 224 and second speaker 225 of FIG. 2, or combinations thereof. The first audio data may include a first audio data signal and a first noise cancellation signal. The first noise cancellation signal may be provided based on the first ambient noise data signal. The second audio data may include a second audio data signal and a second noise cancellation signal. The second noise cancellation signal may be provided based on the second ambient noise data signal.

Figure 4:
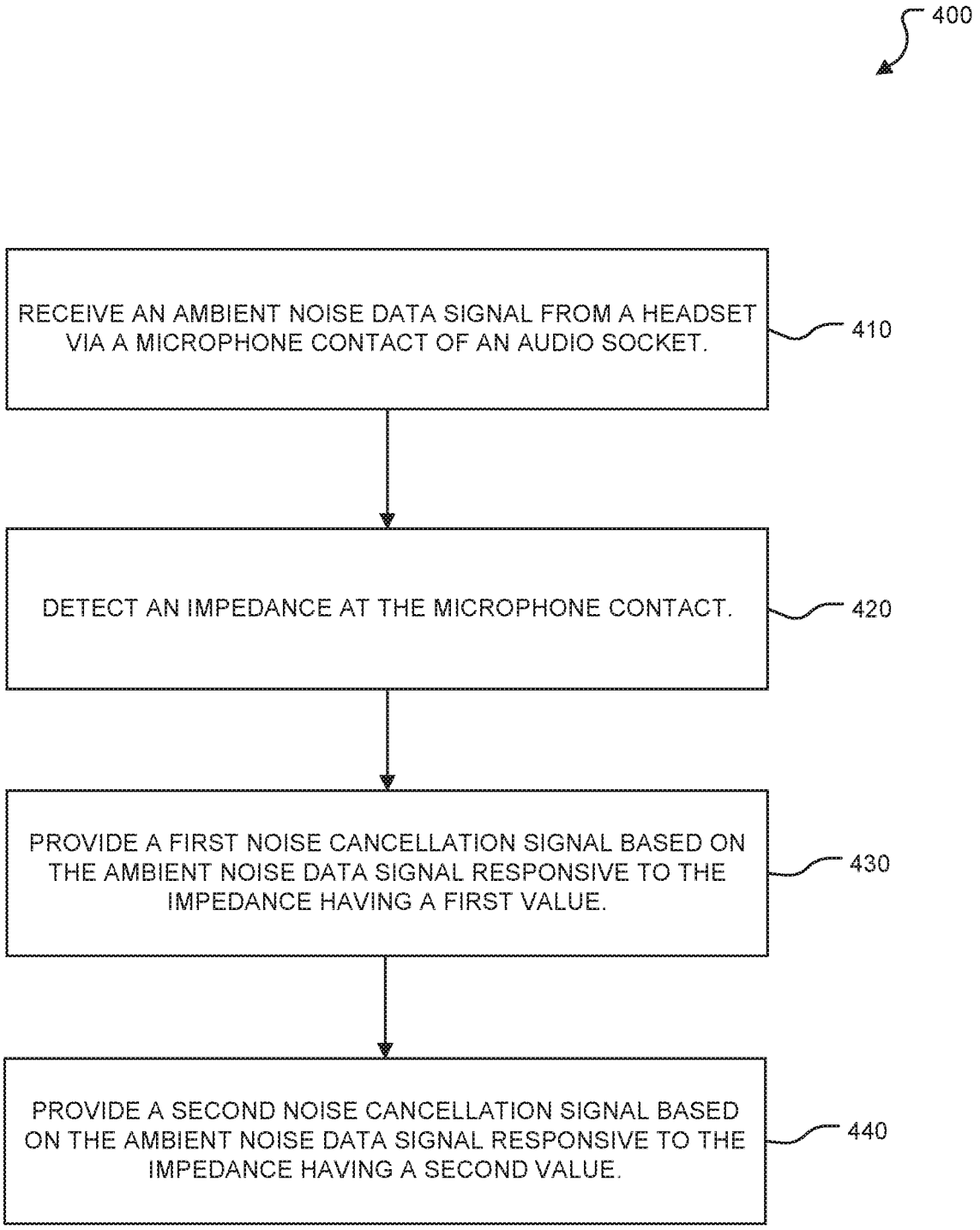
FIG. 4 illustrates a flow diagram of a method to provide noise cancellation in accordance with some embodiments of the disclosure.

FIG. 4 illustrates a flow diagram of a method 400 to provide noise cancellation in accordance with some embodiments of the disclosure. The method 400 may be implemented in the device 110 of FIG. 1.

The method 400 may include receiving an ambient noise data signal from a headset via a microphone contact of an audio socket, at 410. The audio socket may include the audio socket 118 of FIG. 1. The microphone contact may be the microphone/supply contact 246 of FIG. 2. The audio socket may be a 4-contact audio socket configured to receive a 4-pin audio plug.

The method 400 may include detecting an impedance at the microphone contact, at 420. The method 400 may further include providing a first noise cancellation signal based on the ambient noise data signal responsive to the impedance having a first value, at 430. The method 400 may further include providing a second noise cancellation signal based on the ambient noise data signal responsive to the impedance having a second value, at 440. Provision of the first noise cancellation signal based on the ambient noise data signal responsive to the impedance having the first value may include encoding the first noise cancellation signal with a same amplitude and a 180-degree phase offset from an amplitude and phase of the ambient noise data signal. Further, provision of the second noise cancellation signal based on the ambient noise data signal responsive to the impedance having the second value may include encoding the second cancellation signal with a same amplitude and a 180-degree phase offset from an amplitude and phase of the ambient noise data signal. The impedance may differ due to impedances coupled to lines coupled to microphones of an attached headset, such as the resistors R1 and R2 of FIG. 1 or the resistors R1 and R2 of FIG. 2.

In some examples, the method 400 may include encoding a first audio signal that includes first audio data and the first noise cancellation signal, and encoding a second audio signal that includes second audio data and the second noise cancellation signal. In some examples, the method 400 may further include providing the first audio signal to a first speaker contact of the audio socket, and providing the second audio signal to a second speaker contact of the audio socket. The first speaker contact and the second speaker contact may be the first speaker contact 242 and second speaker contact 248 of FIG. 2.

Figure 5:
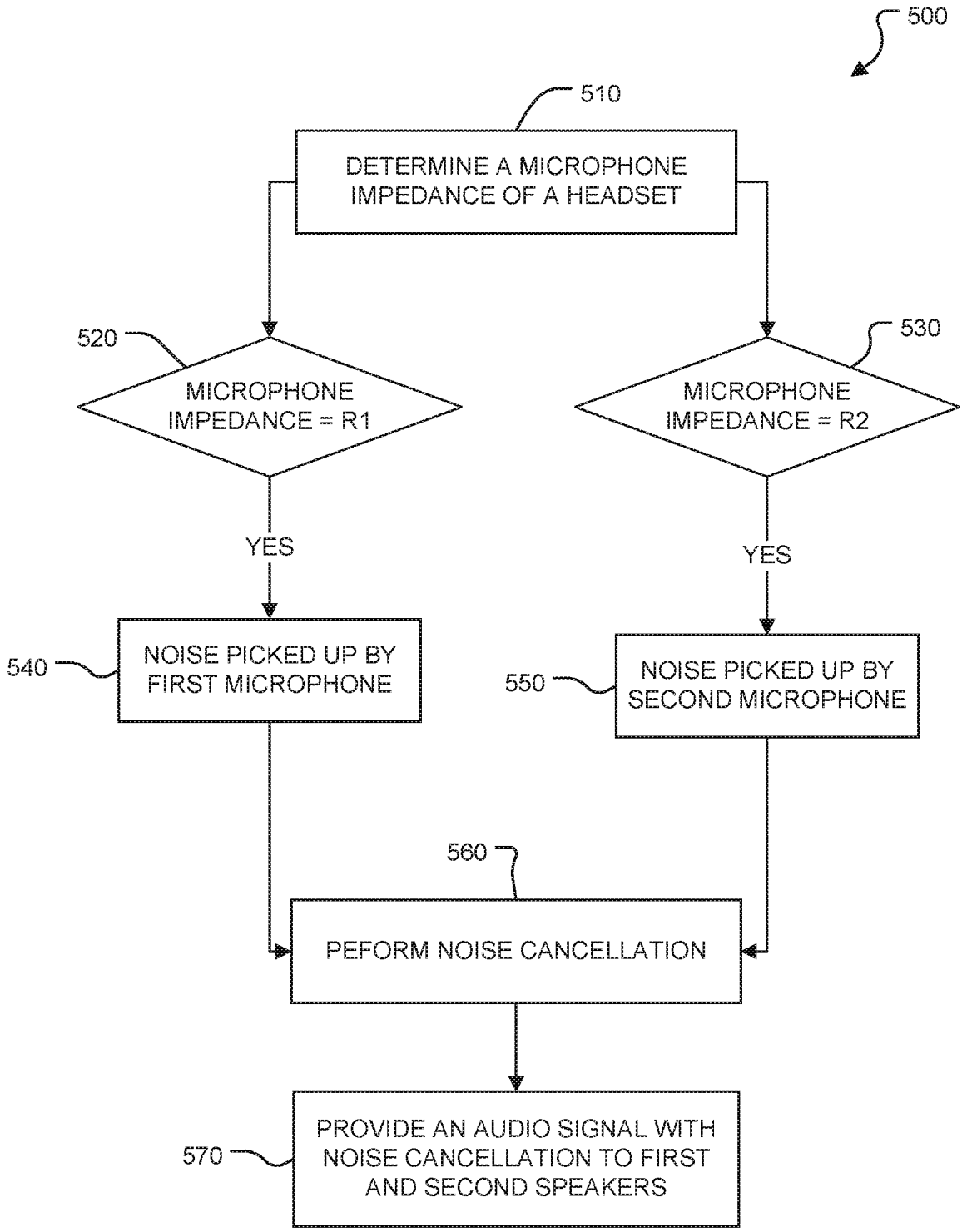
FIG. 5 illustrates a flow diagram of a method to provide noise cancellation in accordance with some embodiments of the disclosure.

FIG. 5 illustrates a flow diagram of a method 500 to provide to provide noise cancellation in accordance with some embodiments of the disclosure. The method 500 may be implemented in the device 110 of FIG. 1.

The method 500 may include determining a microphone impedance of a headset, at 510. The microphone impedance may be determined at a microphone contact of an audio socket, such as the audio socket 118 of FIG. 1.

The method 500 may further include determining whether the microphone impedance matches a first impedance R1, at 520, and determining whether the microphone impedance matches a second impedance R1, at 530. If the microphone impedance matches the first impedance R1, the method 500 may include determining that an ambient noise data signal is received from a first microphone, at 540, such as the first microphone 126 of FIG. 1 or the first microphone 226 of FIG. 2. If the microphone impedance matches the second impedance R2, the method 500 may include determining that the ambient noise data signal is received from a second microphone, at 550, such as the second microphone 127 of FIG. 1 or the second microphone 227 of FIG. 2.

The method 500 may further include performing noise cancellation, at 560. Performing noise cancellation may include providing a first noise cancellation signal based on the ambient noise data signal when received from the first microphone, and providing a second noise cancellation signal based on the ambient noise data signal when received from the second microphone. The noise cancellation signals may have a same amplitude and a 180 degree phase offset from the ambient noise data signal. The method 500 may further include providing an audio signal with noise cancellation to a first and second speaker, at 570. For example, a first audio signal that includes the first noise cancellation signal may be provided to a first speaker and a second audio signal that includes the second noise cancellation signal may be provided to a second speaker. The first and second speaker may include the first and second speakers 124 and 125 of FIG. 1 or the first and second speakers 224 and 225 of FIG. 2.

Figure 6:
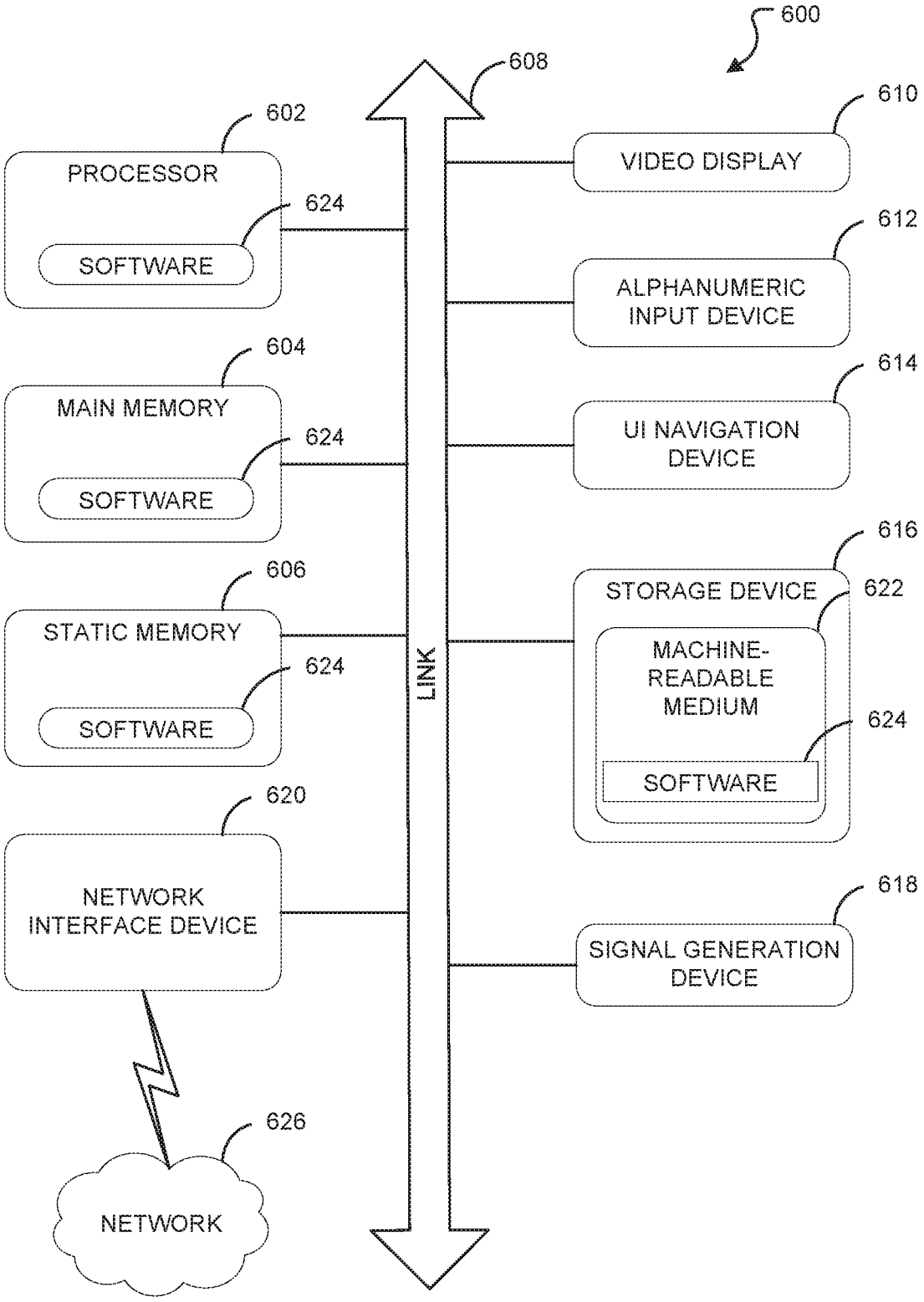
FIG. 6 illustrates a block diagram illustrating a machine in the example form of a computer system in accordance with some embodiments of the disclosure.

FIG. 6 is a block diagram illustrating a machine in the example form of a computer system 600, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be a personal computer (PC), a tablet PC, a hybrid tablet, a server, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 600 includes at least one processor unit 602 (e.g., a central processing unit (CPU), a graphics processing unit (GPU) or both, processor cores, compute nodes, etc.), a main memory 604 and a static memory 606, which communicate with each other via a link 608 (e.g., bus). The computer system 600 may further include a video display unit 610, an alphanumeric input device 612 (e.g., a keyboard), and a user interface (UI) navigation device 614 (e.g., a mouse). In one embodiment, the video display unit 610, input device 612 and UI navigation device 614 are incorporated into a touch screen display. The computer system 600 may additionally include a storage device 616 (e.g., a drive unit), a signal generation device 618 (e.g., a speaker), a network interface device 620, and one or more sensors (not shown), such as a global positioning system (GPS) sensor, compass, accelerometer, gyrometer, magnetometer, or other sensor.

The storage device 616 includes a machine-readable medium 622 on which is stored one or more sets of data structures and instructions 624 (e.g., software) embodying or utilized by any one or more of the methodologies or functions described herein. The instructions 624 may also reside, completely or at least partially, within the main memory 604, static memory 606, and/or within the processor unit 602 during execution thereof by the computer system 600, with the main memory 604, static memory 606, and the processor unit 602 also constituting machine-readable media.

While the machine-readable medium 622 is illustrated in an example embodiment to be a single medium, the term "machine-readable medium" may include a single medium or multiple media (e.g., a centralized or distributed database, and/or associated caches and servers) that store the one or more instructions 624. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 624 may further be transmitted or received over a communications network 626 using a transmission medium via the network interface device 620 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Bluetooth, Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

Various illustrative components, blocks, configurations, modules, and steps have been described above generally in terms of their functionality. Skilled artisans may implement the described functionality in varying ways for each particular application, but such implementation decisions should not be interpreted as causing a departure from the scope of the present disclosure.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as previously described.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the software may reside on at least one machine-readable medium.

The term "module" is understood to encompass a tangible entity, be that an entity that is physically constructed, specifically configured (e.g., hardwired), or temporarily (e.g., transitorily) configured (e.g., programmed) to operate in a specified manner or to perform at least part of any operation described herein. Considering examples in which modules are temporarily configured, a module need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time. The terms "application, process, or service," or variants thereof, is used expansively herein to include routines, program modules, programs, components, and the like, and may be implemented on various system configurations, including single-processor or multiprocessor systems, microprocessor-based electronics, single-core or multi-core systems, combinations thereof, and the like. Thus, the terms "application, process, or service" may be used to refer to an embodiment of software or to hardware arranged to perform at least part of any operation described herein.

While a machine-readable medium may include a single medium, the term "machine-readable medium" may include a single medium or multiple media (e.g., a centralized or distributed database, and/or associated caches and servers).

Additional Notes & Examples

Example 1 is a device to support a noise cancellation function, the device comprising: an audio socket including a microphone contact; and an ambient noise detection module to: receive an ambient noise data signal from a headset via the microphone contact; detect an impedance at the microphone contact; and provide a first noise cancellation signal responsive to the impedance having a first value and to provide a second noise cancellation signal responsive to the impedance having a second value.

In Example 2, the subject matter of Example 1 optionally includes an audio encoder/decoder to encode a first audio signal that includes first audio data and the first noise cancellation signal and to encode a second audio signal that includes second audio data and the second noise cancellation signal.

In Example 3, the subject matter of Example 2 optionally includes a processor and memory to provide raw audio data to the audio encoder/decoder, the audio encoder/decoder further to encode a first audio data based on the raw audio data and to encode a second audio data based on the raw audio data.

In Example 4, the subject matter of any one or more of Examples 1-3 optionally include wherein the audio socket further includes a first speaker contact to receive the first audio signal and a second speaker contact to receive the second audio signal.

In Example 5, the subject matter of any one or more of Examples 1-4 optionally include wherein the audio socket is a 4-contact audio socket to receive a 4-pin audio plug.

In Example 6, the subject matter of any one or more of Examples 1-5 optionally include wherein the ambient noise detection module is able to detect a change in impedance changes that occur at a frequency of 40,000 Hz.

In Example 7, the subject matter of any one or more of Examples 1-6 optionally include wherein the ambient noise detection module is to provide the first noise cancellation signal based on the ambient noise data signal while the impedance has the first value, and wherein the ambient noise detection module is to provide the second noise cancellation signal based on the ambient noise data signal while the impedance has the second value.

In Example 8, the subject matter of any one or more of Examples 1-7 optionally include wherein the ambient noise detection module is to provide the first noise cancellation signal based on the ambient noise data signal while the impedance has the first value, and wherein the ambient noise detection module is to provide the second noise cancellation signal based on the ambient noise data signal while the impedance has the second value.

Example 9 is a headset device to support a noise cancellation function, the headset device comprising: a first microphone associated with a first speaker, a second microphone associated with a second speaker; an audio plug having a single microphone contact; and a controller circuit to oscillate back and forth between coupling the first microphone and the second microphone to the single microphone contact at a predetermined frequency.

In Example 10, the subject matter of Example 9 optionally includes wherein the controller circuit includes a switching circuit to alternatively couple one of the first microphone or the second microphone to the microphone contact.

In Example 11, the subject matter of Example 10 optionally includes wherein the switching circuit includes a single pole, double throw switch.

In Example 12, the subject matter of any one or more of Examples 10-11 optionally include wherein the controller circuit further includes an oscillator circuit to control the switching circuit at the predetermined frequency.

In Example 13, the subject matter of any one or more of Examples 9-12 optionally include wherein the predetermined frequency is based on an audible frequency range of the human ear.

In Example 14, the subject matter of any one or more of Examples 9-13 optionally include wherein the predetermined frequency is further based on a frequency range of ambient noise.

In Example 15, the subject matter of any one or more of Examples 9-14 optionally include wherein the predetermined frequency is 40,000 Hz or less.

In Example 16, the subject matter of any one or more of Examples 9-15 optionally include the first speaker and the second speaker.

In Example 17, the subject matter of any one or more of Examples 9-16 optionally include wherein the audio plug further includes a first speaker contact coupled to the first speaker and a second speaker contact coupled to the second speaker.

In Example 18, the subject matter of any one or more of Examples 9-17 optionally include wherein the audio plug is a 4-pin audio plug.

In Example 19, the subject matter of any one or more of Examples 9-18 optionally include a first resistor coupled between a ground node and a node between the controller circuit and the first microphone, and a second resistor coupled between the ground node and a node between the controller circuit and the second microphone.

In Example 20, the subject matter of Example 19 optionally includes wherein an impedance of the first resistor is different than an impedance of the second resistor.

Example 21 is a method to provide ambient noise data from a headset, the method comprising: at a predetermined frequency, oscillating between: providing a first ambient noise data signal to a microphone contact of an audio plug of the headset; and providing a second ambient noise data signal to the microphone contact of an audio plug of the headset.

In Example 22, the subject matter of Example 21 optionally includes wherein the predetermined frequency is based on an audible frequency range of the human ear.

In Example 23, the subject matter of Example 22 optionally includes wherein the predetermined frequency is further based on a frequency range of ambient noise.

In Example 24, the subject matter of any one or more of Examples 21-23 optionally include wherein the predetermined frequency is 40,000 Hz or less.

In Example 25, the subject matter of any one or more of Examples 21-24 optionally include receiving a first audio signal at a first speaker, wherein the first audio data includes a first audio data signal and a first noise cancellation signal, wherein the first noise cancellation signal is provided based on the first ambient noise data signal; and receiving a second audio signal at a first speaker of the headset, wherein the second audio data includes a second audio data signal and a second noise cancellation signal, wherein the second noise cancellation signal is provided based on the second ambient noise data signal.

In Example 26, the subject matter of any one or more of Examples 21-25 optionally include wherein the oscillating comprises: in an alternating fashion: adjusting a switching circuit to a first configuration to couple the microphone contact to a first microphone to provide the first ambient noise data signal; and adjusting the switching circuit to a second configuration to couple the microphone contact to a second microphone to provide the second ambient noise data signal.

Example 27 is at least one machine-readable medium including instructions that, when executed on a machine cause the machine to perform any of the methods of Examples 21-26.

Example 28 is an apparatus comprising means for performing any of the methods of Examples 21-26.

Example 29 is a method to provide noise cancellation, the method comprising: receiving an ambient noise data signal from a headset via a microphone contact of an audio socket; detecting an impedance at the microphone contact; providing a first noise cancellation signal based on the ambient noise data signal responsive to the impedance having a first value; and providing a second noise cancellation signal based on the ambient noise data signal responsive to the impedance having a second value.

In Example 30, the subject matter of Example 29 optionally includes encoding a first audio signal that includes first audio data and the first noise cancellation signal; and encoding a second audio signal that includes second audio data and the second noise cancellation signal.

In Example 31, the subject matter of Example 30 optionally includes providing the first audio signal to a first speaker contact of the audio socket; and providing the second audio signal to a second speaker contact of the audio socket.

In Example 32, the subject matter of any one or more of Examples 29-31 optionally include wherein the audio socket is a 4-contact audio socket to receive a 4-pin audio plug.

In Example 33, the subject matter of any one or more of Examples 29-32 optionally include where providing the first noise cancellation signal based on the ambient noise data signal responsive to the impedance having the first value comprises encoding the first noise cancellation signal with a same amplitude and a 180-degree phase offset from an amplitude and phase of the ambient noise data signal, and wherein providing the second noise cancellation signal based on the ambient noise data signal responsive to the impedance having the second value comprises encoding the second cancellation signal with a same amplitude and a 180-degree phase offset from an amplitude and phase of the ambient noise data signal.

Example 34 is at least one machine-readable medium including instructions that, when executed on a machine cause the machine to perform any of the methods of Examples 29-33.

Example 35 is an apparatus comprising means for performing any of the methods of Examples 29-33.

Example 36 is an apparatus to provide ambient noise data from a headset, the apparatus comprising: means for providing a first ambient noise data signal to a microphone contact of an audio plug of the headset while a switching circuit is in a first configuration; means for providing a second ambient noise data signal to the microphone contact of an audio plug of the headset while a switching circuit is in a second configuration; and means for oscillating the switching circuit between the first configuration and the second configuration at a predetermined frequency.

In Example 37, the subject matter of Example 36 optionally includes wherein the predetermined frequency is based on an audible frequency range of the human ear.

In Example 38, the subject matter of any one or more of Examples 36-37 optionally include wherein the predetermined frequency is further based on a frequency range of ambient noise.

In Example 39, the subject matter of any one or more of Examples 36-38 optionally include wherein the predetermined frequency is 40,000 Hz or less.

In Example 40, the subject matter of any one or more of Examples 36-39 optionally include means for receiving a first audio signal at a first speaker, wherein the first audio data includes a first audio data signal and a first noise cancellation signal, wherein the first noise cancellation signal is provided based on the first ambient noise data signal; and means for receiving a second audio signal at a first speaker of the headset, wherein the second audio data includes a second audio data signal and a second noise cancellation signal, wherein the second noise cancellation signal is provided based on the second ambient noise data signal.

In Example 41, the subject matter of any one or more of Examples 36-40 optionally include wherein the means for oscillating comprises: in an alternating fashion: means for adjusting a switching circuit to a first configuration to couple the microphone contact to a first microphone to provide the first ambient noise data signal; and means for adjusting the switching circuit to a second configuration to couple the microphone contact to a second microphone to provide the second ambient noise data signal.

Example 42 is an apparatus to provide noise cancellation, the apparatus comprising: means for receiving an ambient noise data signal from a headset via a microphone contact of an audio socket; means for detecting an impedance at the microphone contact; means for providing a first noise cancellation signal based on the ambient noise data signal responsive to the impedance having a first value; and means for providing a second noise cancellation signal based on the ambient noise data signal responsive to the impedance having a second value.

In Example 43, the subject matter of Example 42 optionally includes means for encoding a first audio signal that includes first audio data and the first noise cancellation signal; and means for encoding a second audio signal that includes second audio data and the second noise cancellation signal.

In Example 44, the subject matter of Example 43 optionally includes means for providing the first audio signal to a first speaker contact of the audio socket; and means for providing the second audio signal to a second speaker contact of the audio socket.

In Example 45, the subject matter of any one or more of Examples 42-44 optionally include wherein the audio socket is a 4-contact audio socket to receive a 4-pin audio plug.

In Example 46, the subject matter of any one or more of Examples 42-45 optionally include wherein means for providing the first noise cancellation signal based on the ambient noise data signal responsive to the impedance having the first value comprises means for encoding the first noise cancellation signal with a same amplitude and a 180-degree phase offset from an amplitude and phase of the ambient noise data signal, and wherein means for providing the second noise cancellation signal based on the ambient noise data signal responsive to the impedance having the second value comprises means for encoding the second cancellation signal with a same amplitude and a 180-degree phase offset from an amplitude and phase of the ambient noise data signal.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplate are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. However, the claims may not set forth features disclosed herein because embodiments may include a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A headset device to support a noise cancellation function, the headset device comprising: a first microphone associated with a first speaker; a second microphone associated with a second speaker; an audio plug having a single microphone contact; and a controller circuit to oscillate back and forth between coupling the first microphone and the second microphone to the single microphone contact at a predetermined frequency; wherein the controller circuit includes a switching circuit to alternatively couple one of the first microphone or the second microphone to the microphone contact.

2. The headset device of claim 1, wherein the switching circuit includes a single pole, double throw switch.

3. The headset device of claim 1, wherein the controller circuit further includes an oscillator circuit to control the switching circuit at the predetermined frequency.

4. The headset device of claim 1, wherein the predetermined frequency is based on an audible frequency range of the human ear.

5. The headset device of claim 1, wherein the predetermined frequency is further based on a frequency range of ambient noise.

6. The headset device of claim 1, wherein the predetermined frequency is 40,000 Hz or less.

7. The headset device of claim 1, further comprising the first speaker and the second speaker.

8. The headset device of claim 1, wherein the audio plug further includes a first speaker contact coupled to the first speaker and a second speaker contact coupled to the second speaker.

9. The headset device of claim 1, wherein the audio plug is a 4-pin audio plug.

10. The headset device of claim 1, further comprising:

a first resistor coupled between a ground node and a node between the controller circuit and the first microphone.

11. A method to provide ambient noise data from a headset, the method comprising: at a predetermined frequency, oscillating between: providing a first ambient noise data signal to a microphone contact of an audio plug of the headset; and providing a second ambient noise data signal to the microphone contact of an audio plug of the headset; alternatively coupling one of the first microphone or the second microphone to the microphone contact using a switching circuit.

12. The method of claim 11, wherein the predetermined frequency is based on an audible frequency range of the human ear and based on a frequency range of ambient noise.

13. The method of claim 11, further comprising:

receiving a first audio signal at a first speaker, wherein the first audio data includes a first audio data signal and a first noise cancellation signal, wherein the first noise cancellation signal is provided based on the first ambient noise data signal; and receiving a second audio signal at a first speaker of the headset, wherein the second audio data includes a second audio data signal and a second noise cancellation signal, wherein the second noise cancellation signal is provided based on the second ambient noise data signal.

14. The method of claim 11, wherein the oscillating comprises:

in an alternating fashion:

adjusting a switching circuit to a first configuration to couple the microphone contact to a first microphone to provide the first ambient noise data signal; and adjusting the switching circuit to a second configuration to couple the microphone contact to a second microphone to provide the second ambient noise data signal.

* * * * *